US009796105B2

(12) United States Patent
Paul et al.

(10) Patent No.: US 9,796,105 B2
(45) Date of Patent: Oct. 24, 2017

(54) TOOL FOR CRUSHING COKE IN DRUMS BY MEANS OF HIGH-PRESSURE WATER JETS

(71) Applicant: Ruhrpumpen GmbH, Witten (DE)

(72) Inventors: Wolfgang Paul, Hamburg (DE); Thomas Hoppe, Witten (DE); Andreas Wupper, Recklinghausen (DE)

(73) Assignee: Ruhrpumpen GmbH, Witten (DE)

( * ) Notice: Subject to any disclaimer, the term of this patent is extended or adjusted under 35 U.S.C. 154(b) by 578 days.

(21) Appl. No.: 14/325,416

(22) Filed: Jul. 8, 2014

(65) Prior Publication Data

US 2015/0047483 A1 Feb. 19, 2015

(30) Foreign Application Priority Data

Aug. 13, 2013 (DE) ..... 10 2013 108 755
Jan. 24, 2014 (DE) ..... 10 2014 100 834

(51) Int. Cl.
*B02C 19/18* (2006.01)
*B26F 3/00* (2006.01)

(52) U.S. Cl.
CPC ..... *B26F 3/004* (2013.01); *B26F 2003/006* (2013.01); *Y10T 83/0591* (2015.04); *Y10T 83/364* (2015.04)

(58) Field of Classification Search
CPC ..... B26F 3/004; B26F 2003/006; Y10T 83/0591; Y10T 83/364; B02C 19/18
USPC ..... 241/1, 301
See application file for complete search history.

(56) References Cited

U.S. PATENT DOCUMENTS 5,816,505 A 10/1998 Tran et al.
5,831,224 A * 11/1998 Wattles ..... B26F 3/008 181/233
8,770,494 B2 * 7/2014 Arzuaga ..... C10B 33/006 202/241
2003/0127251 A1 * 7/2003 Mazorow ..... E21B 4/00 175/62
2012/0138324 A1 6/2012 Paul
2012/0199672 A1 8/2012 Arzuaga

FOREIGN PATENT DOCUMENTS

DE 102011053852 A1 3/2012
WO 2012109211 A1 8/2012

* cited by examiner

*Primary Examiner* — Mark Rosenbaum
(74) *Attorney, Agent, or Firm* — Bachman & LaPointe, PC

(57) ABSTRACT

The invention relates to a tool for crushing coke in drums with of high-pressure water jets, which has a housing 2 with a feed system 4 for high-pressure water, and a housing wall 3 with outwardly directed boring and cutting nozzles 5*a*, 5*b*, out of the openings 7 of which high-pressure water jets 28 exit, as well as flow channels 4*g*, 4*h*, which connect the feed system 4 with the boring and cutting nozzles 5*a*, 5*b*. So that the opening of the boring and cutting nozzles is permanently protected and kept free of deposits of coke or the like, the opening of the boring or cutting nozzle is respectively closable by a one- or multi-part flap, which is adjustable between a closed position and an open position.

15 Claims, 11 Drawing Sheets

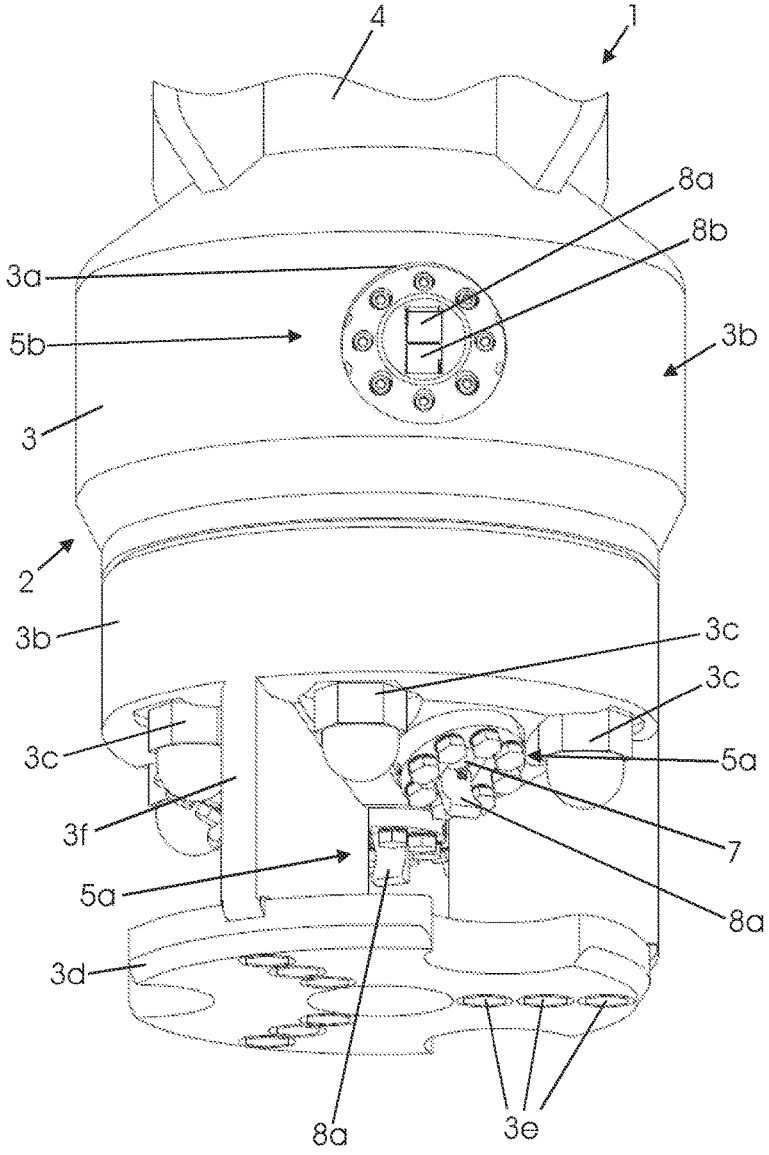
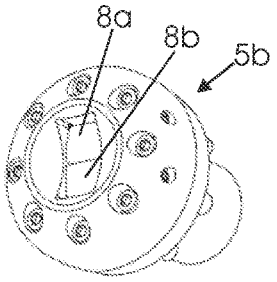
Fig. 14a
Fig. 14

TOOL FOR CRUSHING COKE IN DRUMS BY MEANS OF HIGH-PRESSURE WATER JETS

BACKGROUND OF THE INVENTION

The invention relates to a tool for crushing coke in drums by means of high-pressure water jets, which has a housing with a feed system for high-pressure water and a housing wall with outwardly directed boring and cutting nozzles, out of the openings of which high-pressure water jets exit as well as flow channels, which connect the feed system with the boring and cutting nozzles.

In oil refineries, the last, otherwise no longer usable, fraction of the crude oil is converted to coke. The conversion takes place by introducing this fraction to drums, which fill with coke as the operating time progresses. When the maximum fill level of the drums is reached, the coke is cut out of the drums.

This process, called "decoking", is normally performed with high-pressure water jets, which crush the coke and flush it out of the drums. The tool for generating these high-pressure water jets is inserted into the drum from above via a boring rod. The "decoking" is performed in two sections. First, an opening is bored in the drum from top to bottom by the tool, then the tool is guided back to the top end of the drum and the coke is now crushed by the high-pressure water jets, which exit from it approximately at a right angle to the longitudinal axis of the tool.

The tool, which is for example known from DE 10 2011 053 852 A1, is thus designed for two operating states: first for the boring of an opening, which is required for moving the tool and the later discharging of crushed coke, and second for cutting the coke away from the cross-section of the drum. Accordingly, boring nozzles first send high-pressure water jets mainly parallel or also at an acute angle to an axis, which is formed by the boring rod and the opening formed during boring. Cutting nozzles in contrast generate high-pressure water jets, which are directed mainly at a right angle or at a flat angle to the axis formed by the boring rod and the opening in the drum and pass through a spiral channel for loosening, crushing and flushing out the coke when the tool with the rotating boring rod is lowered into the drum.

This results in that the cutting nozzles are inactive when the boring nozzles are activated and, vice versa, the boring nozzles are inactive when the cutting nozzles are activated. In interim periods, the boring and cutting nozzles can both be inactive.

No high-pressure water passes through an inactive nozzle from inside to outside so that there is a risk that coke particles are deposited on or in the outer opening of an inactive nozzle and the opening of the nozzle is plugged completely or partially so that the nozzle, when high-pressure water is again supplied to it from inside, cannot deliver a high-pressure water jet or only a high-pressure water jet, the jet shape of which is impaired.

It is known from WO 2012/109211 to permanently flush inactive nozzles via a bypass with pressure reduction and check valve for return flow prevention and for avoiding coke deposits on the nozzle opening. However, the construction effort for such a bypass system is relatively high. And, as a result, coke particles can still be deposited at least on the outside on the opening of the nozzle with the result that the delivery of a high-pressure water jet from the nozzle is impaired when the nozzle is activated again.

Thus, the object is to design a tool of the initially named type such that the opening of the boring and cutting nozzles is permanently protected and is kept free of deposits.

SUMMARY OF THE INVENTION

This object is solved according to the invention in that each of the openings of the boring or cutting nozzle is closable with a flap, which is adjustable between a closed position and an open position.

According to this solution, the opening of a boring or cutting nozzle (with respect to common characteristics also just called "nozzle" below) remains closed when no high-pressure water for generating high-pressure water jets is supplied to it from inside, that is when the nozzle is inactive, by a flap and is protected from mechanical wear from coke particles or the like. This protective effect of the flap in the closed position does not only extend to the times when the tool is in operation but rather the flap forms a permanent protective cover so that the opening of the nozzle is not exposed to wear or is only exposed to relatively little wear.

As soon as the nozzle is activated, the flap is shifted from the closed position into an open position by the pressurized water supplied to the nozzle from inside and the high-pressure water jet now exiting the opening of the nozzle, in which the flap dears the path for the high-pressure water jet exiting the opening. The flap can be produced as a pressure diecast part made of a steel substance.

As soon as the portion of the decoking process, which includes the high-pressure water jets exiting the nozzle, is complete, the nozzle becomes inactive, i.e. no more high-pressure water is supplied to it from the inside. This is the moment when the flap returns from the open position to the closed position in which it closes the opening of the nozzle again.

The adjustment of the flap from the closed position to the open position and vice versa is preferably enabled in that the flap is attached on one end of a nozzle channel next to the opening of the boring and cutting nozzle respectively with a swivel joint on the housing of the tool. In other words, the adjustment of the flap occurs through a pivot movement of the flap at the beginning and end of the active state of the nozzle.

The swivel joint of the flap is preferably fastened to the housing in front of the opening of the boring or cutting nozzle with a mainly horizontally positioned rotational axis when the tool is in operation, when it is a cutting nozzle, so that the flap is pivoted from the open position to the closed position during the switch from an active phase of the cutting nozzle, in which the flap is held in the open position by the high-pressure water jet exiting the opening of the cutting nozzle, to an inactive phase of the cutting nozzle, in which no high-pressure water jet exits from the opening of the cutting nozzle, under the impact of the force resulting from its weight.

The actuation force for adjusting the flap from the closed position to the open position thus results from the high-pressure water exiting the opening of the boring or cutting nozzle at the start of an active phase and the force required to pivot the flap from the open position into the closed position, when the flap is no longer supported by the high-pressure water jet exiting the opening, results from the weight of the flap so that any controlling of the position of the flap from the outside is omitted and the adjustment takes place automatically.

However, the tool is preferably provided with a spring, which causes the pivot movement of the flap from the open position to the closed position and vice versa and holds the flap in the inactive phase of the boring or cutting nozzle in its closed position. The spring supports the pivot movement of the flap from the open position into the closed position or guides it along alone and holds the flap in the closed position. However, the swivel joint of the flap can also only experience a support of the already present weight as closing force through a spring, when the weight generally exerts a closing effect like with cutting nozzles. In any case, a flap with a spring has the advantage of being similarly usable for closing and protecting cutting nozzles and boring nozzles and of being independent of the respective position of the nozzle.

The opening of the boring or cutting nozzle and the flap are preferably arranged on a nozzle flange attached on the housing. Should the opening of the boring or cutting nozzle be damaged or partially closed by coke particles despite the protective effect of the flap, the affected nozzle can be easily replaced in that the affected nozzle flange is loosened from the housing and replaced by a new flange.

The spring is preferably arranged in a protected position on the swivel joint, namely preferably as a leg spring in a recess on the upper flap end, where the flap flows out like a fork and the spring is arranged between the two fork legs.

The opening of the boring or cutting nozzle is preferably surrounded on the outside on the housing of the tool by a collar, which has an upper gap on its top side, in which the upper end of the flap is arranged with the swivel joint. The collar thus serves not only to attach or form the swivel joint of the flap but also simultaneously protects the opening and the flap itself from mechanical impairment from the outside. In this embodiment, the upper end of the flap is part of the swivel joint and is located in the upper gap of the collar. The collar is thereby preferably designed as one piece with the nozzle flange or is fastened, e.g. welded, on it.

A further embodiment of this structure of the swivel joint is characterized in that the swivel joint is made of a pin bridging the upper gap and anchored in the upper collar ends on both sides of the upper gap as rotational axis and a corresponding bearing bore in the upper end of the flap, with which the pin forms the swivel joint. Alternatively, the bearing bores can also be arranged in the collar ends and the pin itself in the upper end of the flap for formation of the swivel joint. In each case, an insensitive, reliably acting swivel joint is formed, which is constantly lubricated with pressurized water.

The collar preferably has opposite to the first gap a second lower gap on its bottom end, into which the lower end of the flap pivots when the flap assumes its closed position. In this manner, the lower end of the flap in the closed position lies protected from mechanical damage and is also immovable in this second gap in the collar. Thus, in the closed position of the flap, not only the opening of the nozzle is securely covered by the flap but also the flap itself is protected from mechanical damage and it lies almost immoveable within the collar with its ends in the first and in the second gap of the collar.

The flap can have a level, circular projection on its inside, which in the closed position abuts against a projection of the boring or cutting nozzle surrounding the opening of the boring or cutting nozzle, wherein the projection has a bearing surface complementary to a bearing surface of the initially named projection. It is achieved through this design of the inside of the flap and the surrounding of the opening that the flap reliably closes the opening in the closed position.

A very important further embodiment of the flap according to the invention results when the flap is designed in multiple parts and comprises opposite-lying respectively pivotingly mounted wings, which close the opening of the boring or cutting nozzle in the closed position like rotatable gate wings when they are adjacent to each other in a plane vertical to a nozzle channel and release the opening in that they are respectively rotated to the outside in a pivoting manner. Also in this case, the use of a spring, advantageously a torsion spring, is preferred for each wing so that the wings are pressed and held in the closed position in an inactive phase of the respective nozzle. Through the use of two opposite-lying wings as the flap, less space is needed for the respective pivot movement outside near the opening of the nozzle and the wings are more easily arranged close to the housing compared to a one-piece flap. As will be clarified below, the wings of a two-piece flap can be designed and arranged so that their movement profile lies entirely or almost entirely within the housing profile. In the case of a one-piece flap, it is almost impossible in the open position to keep its free end from protruding to the outside over the housing profile so that in unfavorable circumstances contact with the coke surrounding the tool cannot be completely excluded.

The wings are expediently arranged in a preferably rectangular recess of a protective cap attached in the area of the opening. The protective cap is advantageously attached to the nozzle flange so that the material processing necessary to receive the wings is easier to perform than a replacement of the protective cap when there is e.g. wear or the like on the wings. In any case, the wings are arranged secure and protected in the recess of the protective cap. The shape of a rectangular recess corresponds with the preferred shape of a wing pair and their movement play during the switch from the open position to the closed position and vice versa.

For the shape and for the dimensions of the recess, it is expedient if the width of the recess is greater than the diameter of the opening of the boring or cutting nozzle such that receiving areas for the wings are formed behind a ledge. In other words, receiving areas that are larger than the diameter of the opening connect to the opening so that corresponding ledges are created. The recess in the protective cap and the dimensions of the wings should thereby be coordinated so that the wings neither protrude over the recess in the open position nor in the closed position.

It is incidentally expedient that the wings are mounted opposite each other in a rotary manner with parallel rotational axes in the recess respectively by means of a pin. In this manner, a secure pivoting of the wings from the closed position to the open position and vice versa in the recess is ensured.

An important further embodiment of the multi-part flap consists in that the wings in the inactive phase of the boring or cutting nozzle are pressed into the closed position by means of torsion springs and in the active phase of the boring or cutting nozzle are pivoted and held by the high-pressure water jet against the spring effect in the open position, in which they release the opening of the boring or cutting nozzle. It is ensured in this manner that the wings are pressed into the closed position and held there above all in the inactive phase of the respective nozzle by the torsion springs. The torsion springs are thereby to be measured such that the wings are securely pivoted and held in the open position by the high-pressure water jet during the switch from the closed position to the open position so that they release the opening of the boring or cutting nozzle and the high-pressure water jet can exit unhindered.

The narrow sides of the wings facing each other in the closed position of the boring or cutting nozzle are preferably respectively designed rounded at at least one edge for pivoting the wings into the closed position. An unhindered pivoting of the wings from the open position to the closed position and vice verse is possible through the rounding of this edge at each of the two wings. Without a rounding, that is with rectangular edges on the narrow sides facing each other, a pivot movement of the wings to the outside would not be possible because the radius from one edge to the rotational axis of a wing is greater than the radius from the middle of the narrow side to the rotational axis.

The invention also comprises a nozzle, both boring or cutting nozzle, for a tool for crushing coke in drums by means of high-pressure water jets, wherein the nozzle is closable with a one-part or multi-part flap, which is adjustable between a closed position and an open position. Explanations for the nozzle according to the invention can be found in the preceding description of the tool according to the invention.

Moreover, the invention comprises a method for operating a tool for crushing coke in drums by means of high-pressure water jets, wherein the method is performed with a tool as described above.

BRIEF DESCRIPTION OF THE DRAWINGS

Exemplary embodiments of the invention are explained below based on the drawings. The drawings show:

FIG. 14 a perspective view of a bottom part of the tool with boring and cutting nozzles respectively with a multi-part flap in boring mode;

FIG. 14*a* a perspective view of a cutting nozzle with a multi-part flap in a closed position;

DETAILED DESCRIPTION

Figure 1:
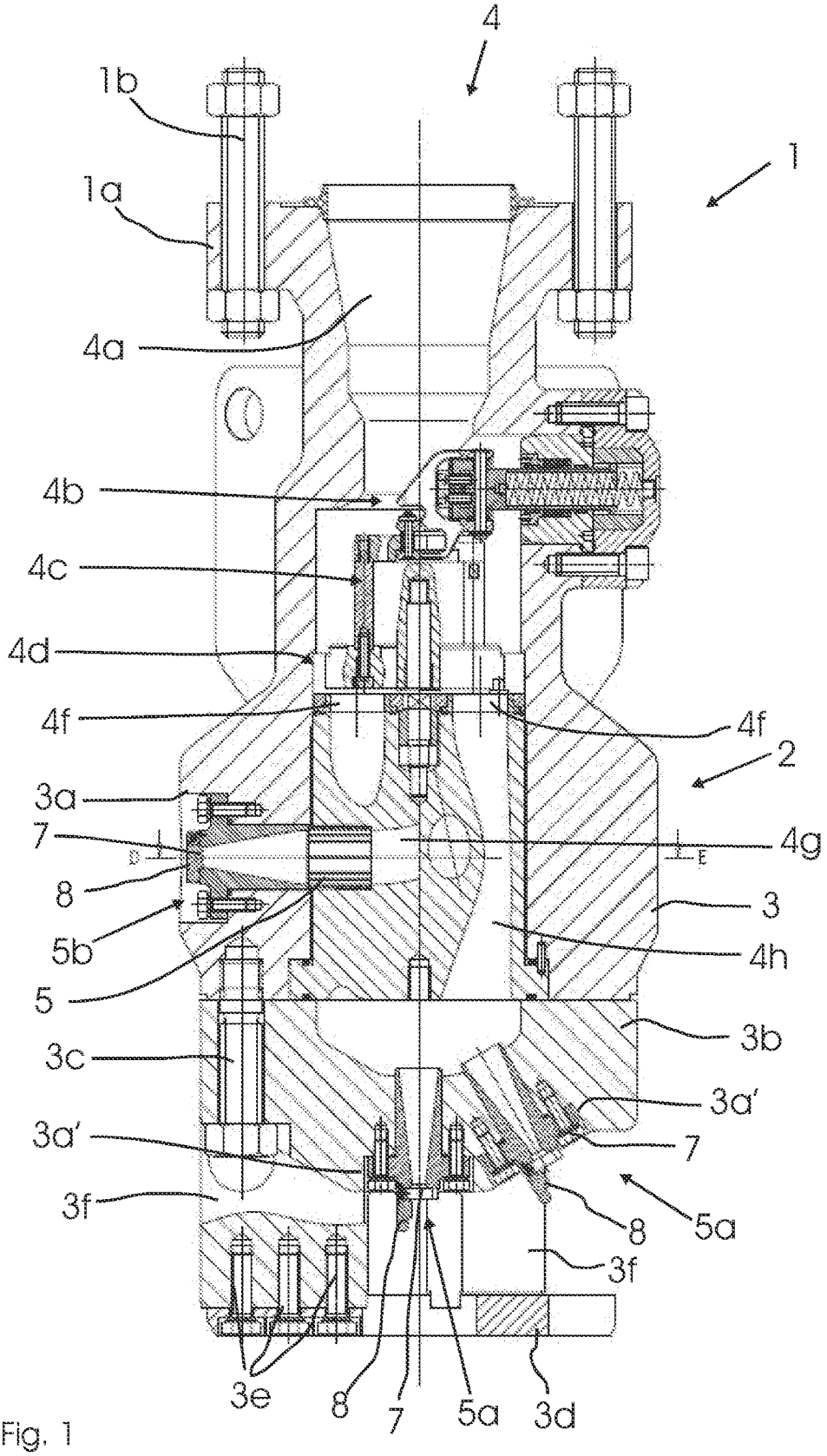
FIG. 1 a representation of a tool in boring mode as a longitudinal sectional view along the cutting line A-C of FIG. 3.
Figure 2:
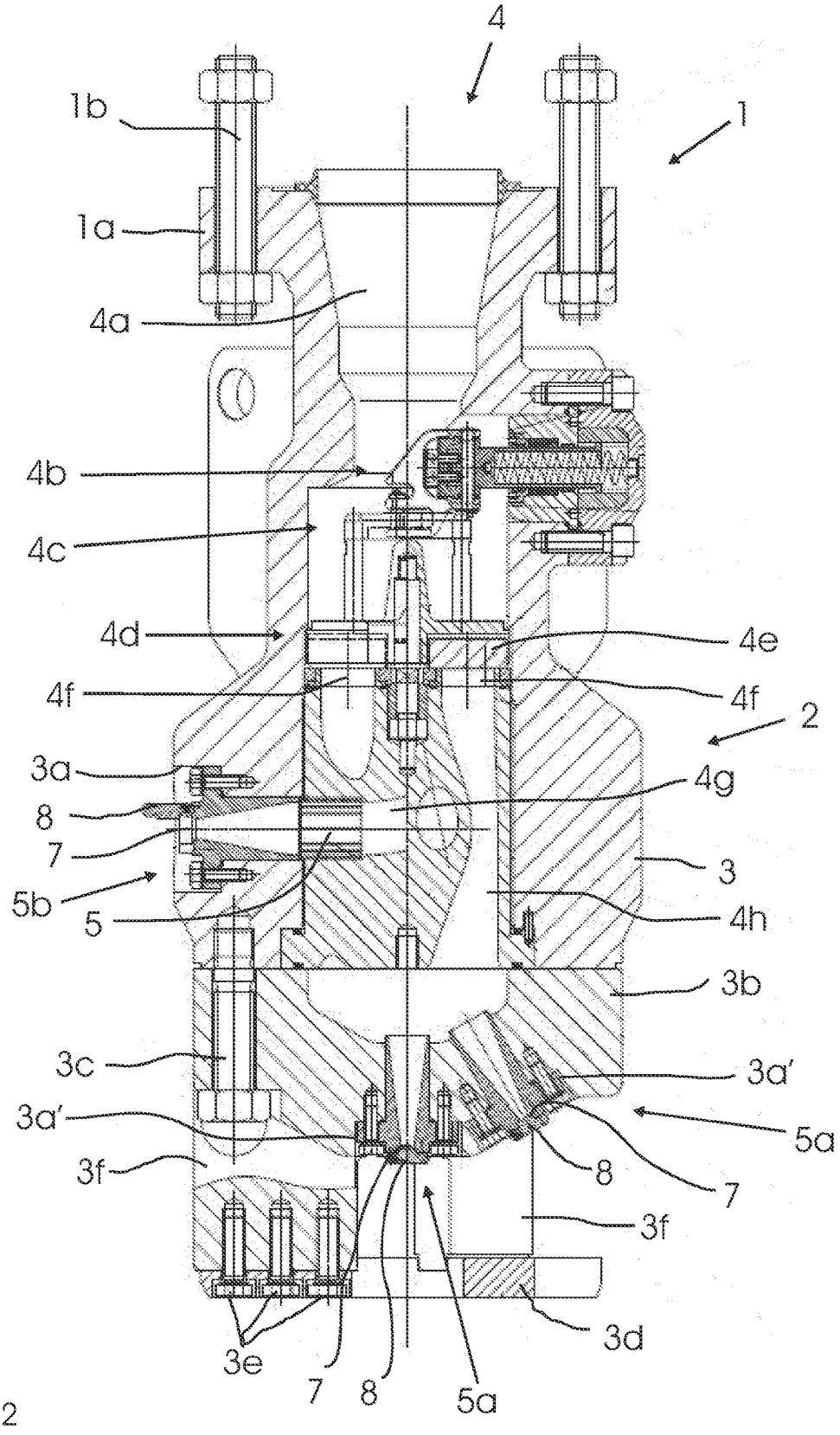
FIG. 2 a longitudinal sectional view of the tool as in FIG. 1, but in cutting mode.
Figure 3:
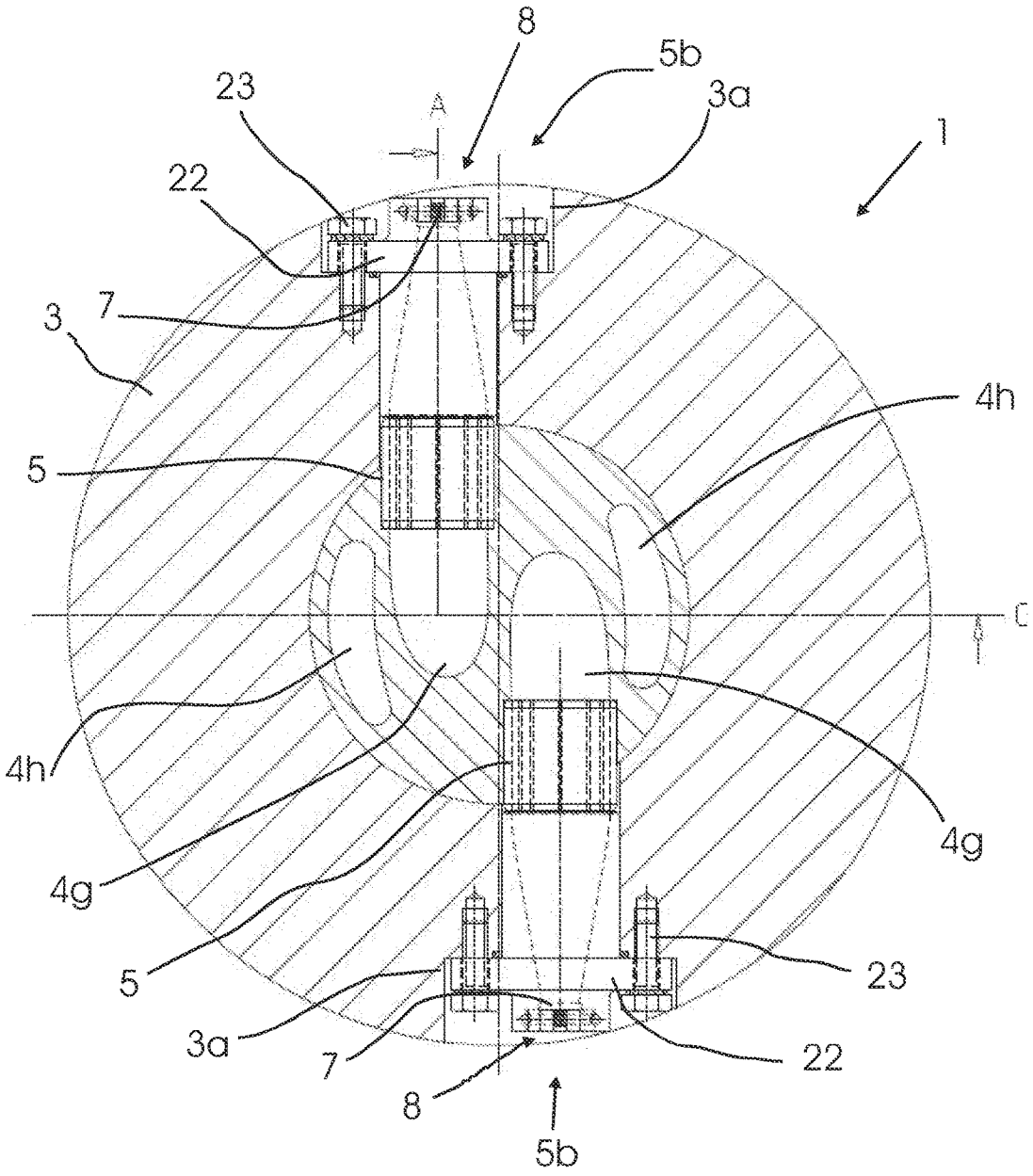
FIG. 3 a cross-sectional view of a bottom part of the tool of FIG. 1 in boring mode along the cutting line D-E of FIG. 1.

FIGS. 1-3 show a tool 1 for performing a "decoking" process. The tool 1 is fastened with a flange is and screws 1*b* on a boring rod (not shown), which is connected with a high-pressure water source (also not shown) in a known manner.

The tool 1 has a housing 2 with a housing wall 3, on the bottom side of which a bottom part 3*b* is fastened by means of screws 3*c*. A base plate 3*d* is attached to it via three bars 3*f* by means of screws 3*e* as bottom closure of the tool 1.

A feed system 4 for high-pressure water has an upper feed channel 4*a*, through which high-pressure water flows in past a switching device 4*b* through a control device 4*c* as well as through a valve device 4*d* to channel openings 4*f*, which are alternatingly closed and opened by valve bodies 4*e*. The switching device 4*b* switches the control device 4*c* depending on a changeover pressure from a boring mode to a cutting mode and vice versa so that the channel openings 4*f* of channels 4*g*, 4*h* leading to cutting nozzles 5*b* and to boring nozzles 5*a* are closed or respectively opened alternatingly by the valve bodies 4*e*. The switching device 4*b* is known as well as the control device 4*c* with the valve device 4*d*, which shifts the valve bodies 4*e* over the channel openings 4*f* for closing or respectively opening them so that the representations for this are not described in further detail.

Cutting nozzles 5*b* that do not protrude over the housing wall 3 each engage in receiving openings 3*a* in the middle part of the housing wall 3 with a rectifier 5, the openings 7 of the cutting nozzles 5*b* being closed by a flap 8. This flap is adjustable respectively from a closed position (FIG. 1) to an open position (FIG. 2), namely pivotable by a swivel joint 11, as will still be explained based on other figures.

In the bottom part 3*b* of the housing 2, boring nozzles 5*a* engage in receiving openings 3*a*', the opening 7 of which is also to be opened and closed by means of a pivotable flap 8. The tool 1 is in the boring mode (FIG. 1) when high-pressure water is supplied to the boring nozzles 5*a* via the channels 4*h*, which pivots the flaps 8 out of the closed position into the open position so that high-pressure water jets 28 exit the boring nozzles 5*a* and hold the flap 8 in the open position. If instead the channels 4*h* are closed and the channels 4*g* are open and high-pressure water is supplied, it flows through the channels 4*g* and the rectifiers 5 to the cutting nozzles 5*b* so that the flap 8 located in the closed position of each cutting nozzle 5*b* is pivoted out of the closed position into the open position and a high-pressure water jet 28 (FIG. 9) exits the opening 7 of each cutting nozzle 5*b* and holds the flap 8 in the open position. The tool 1 is now in cutting mode, from which it can be returned to boring mode as needed. When the tool 1 is idle, the flaps 8 of the boring and cutting nozzles 5*a*, 5*b* are closed.

Figure 5:
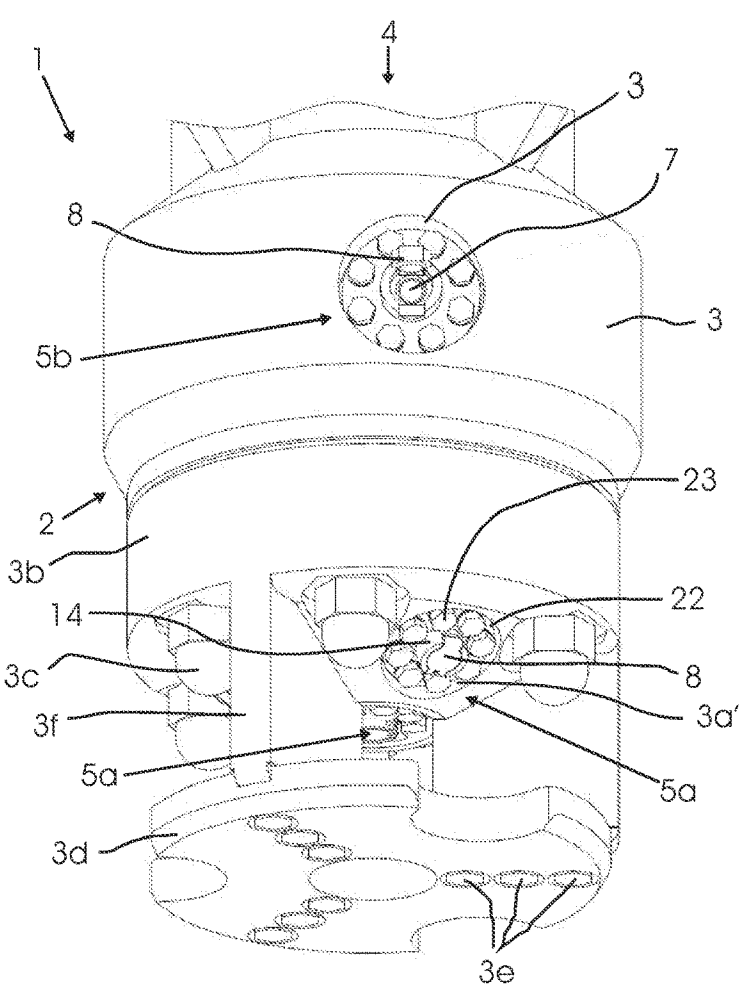
FIG. 5 a perspective view of the bottom part of the tool as in FIG. 4, but here in cutting mode.
Figure 4:
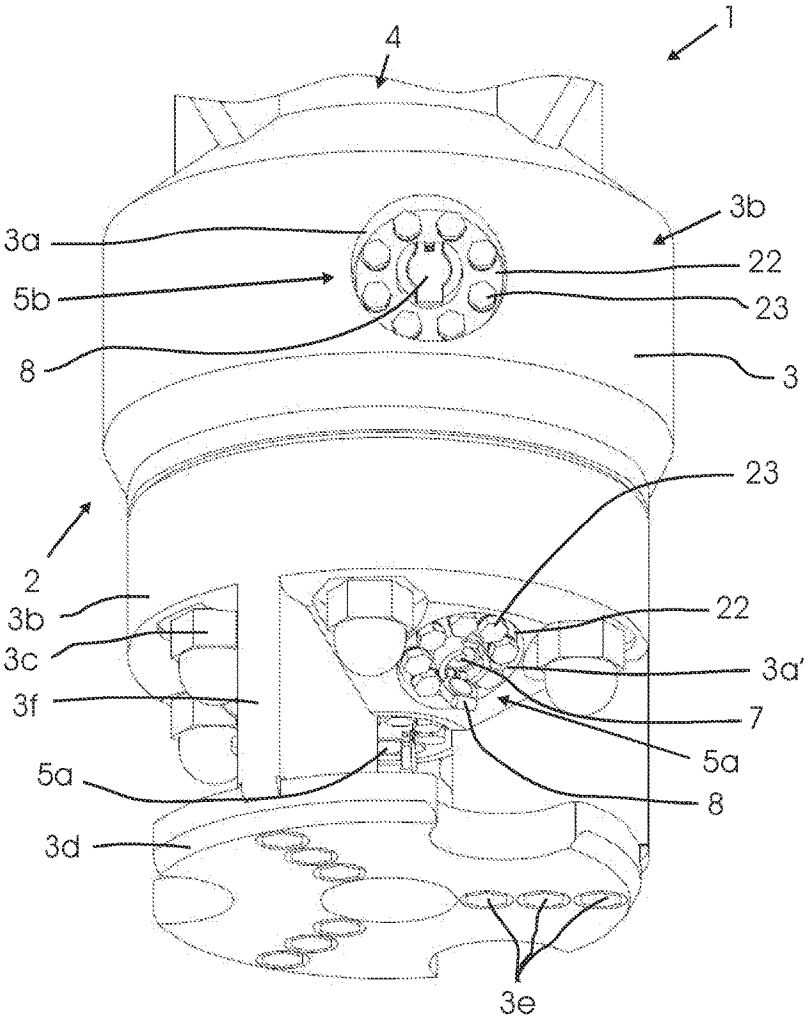
FIG. 4 a perspective view of a bottom part of the tool of FIGS. 1 and 3 in boring mode.

FIGS. 4 and 5 each show the bottom part 3*b* of the housing 2 of the tool 1. In FIG. 4, the tool 1 is in boring mode, where a high-pressure water jet 28 (FIG. 9) exits the opening 7 in the boring nozzle 5*a* opened by the flap 8, while the cutting nozzle 5*b* is closed by the flap 8. However, in FIG. 5, the tool 1 is in cutting mode so that the flap 8 of the cutting nozzle 5*b* is pivoted into the open position and has opened the opening 7 of the cutting nozzle 5*b* for the discharge of a high-pressure water jet 28, while the boring nozzle 5*a* is inactive, namely closed by the flap 8.

Figure 7:
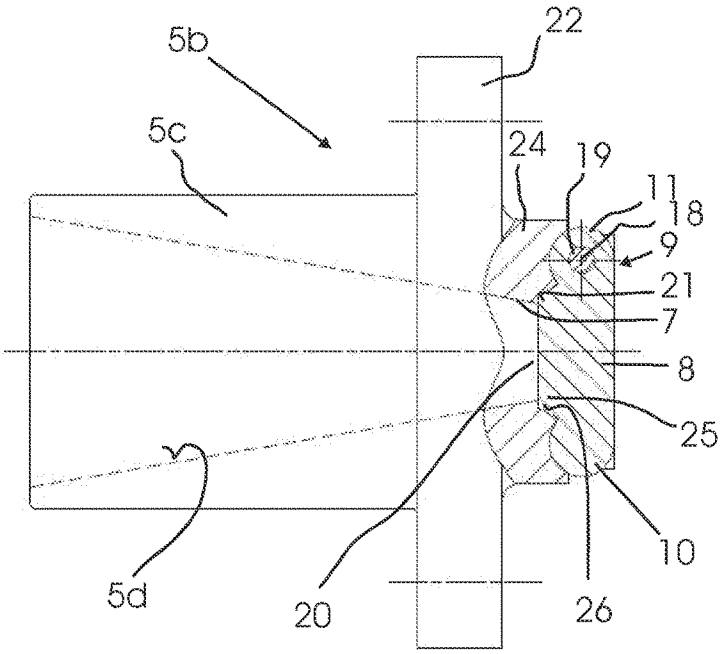
FIG. 7 a side view of the cutting nozzle from FIG. 6, partially as a sectional view.
Figure 6:
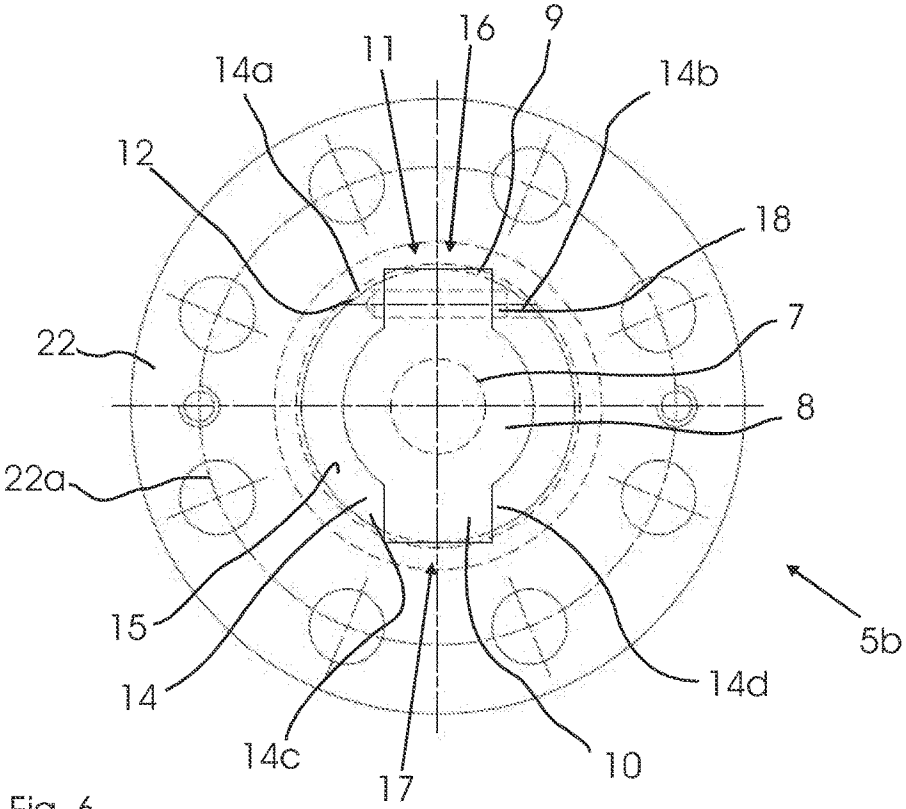
FIG. 6 a top view of a cutting nozzle of the tool in boring mode.
Figure 9:
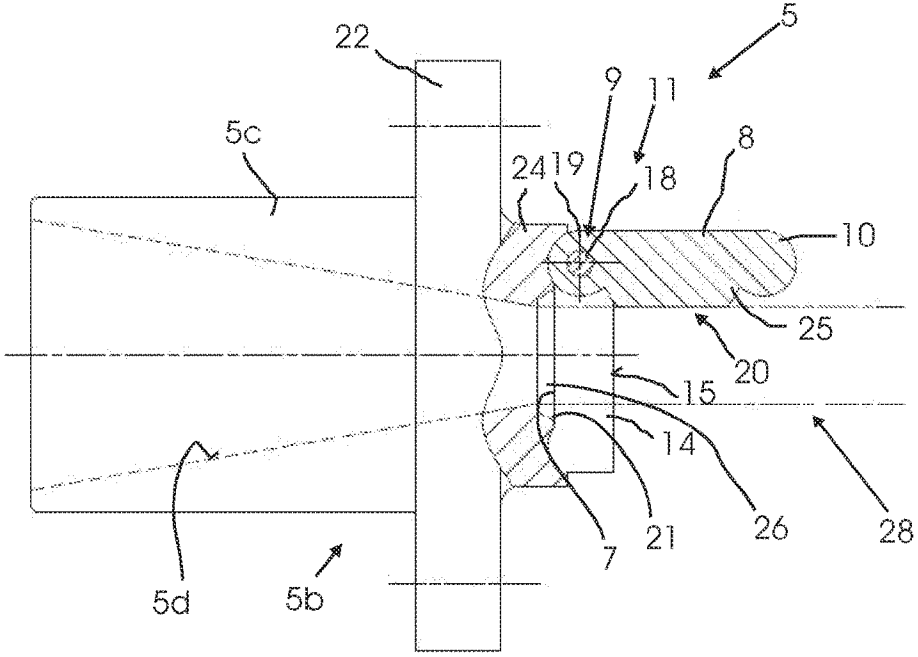
FIG. 9 a side view of the cutting nozzle from FIG. 8, partially as a sectional view.
Figure 8:
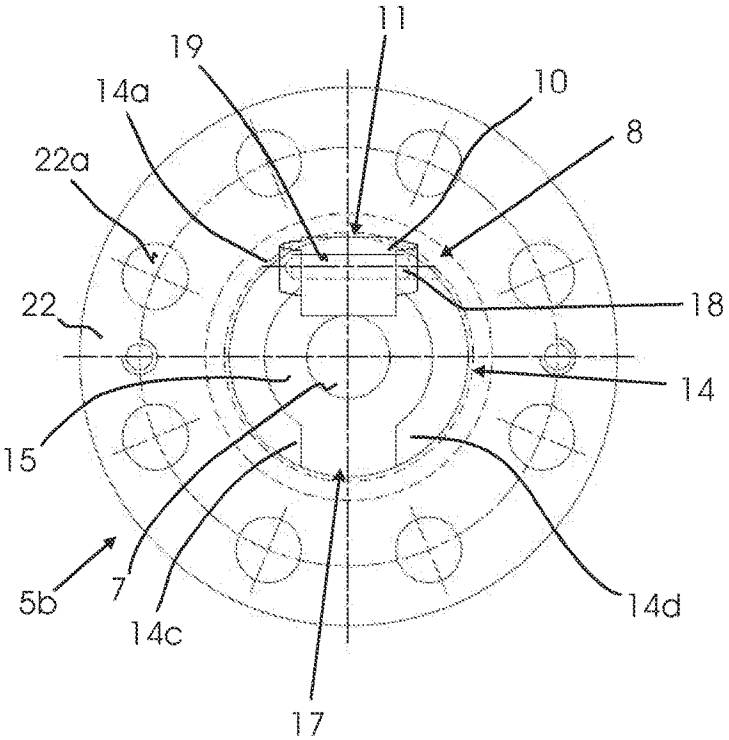
FIG. 8 a top view of the cutting nozzle of FIGS. 6 and 7 in cutting mode.
Figure 11:
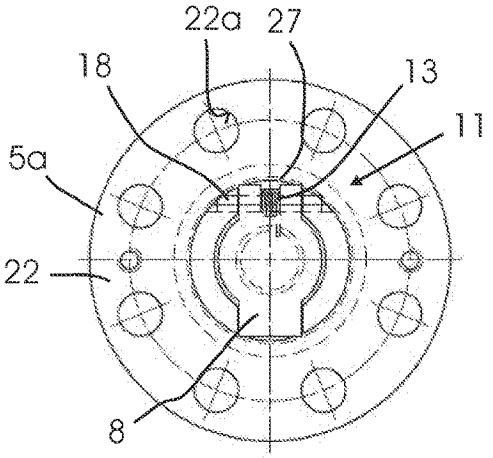
FIG. 11 a top view of the boring nozzle of FIG. 10.
Figure 13:
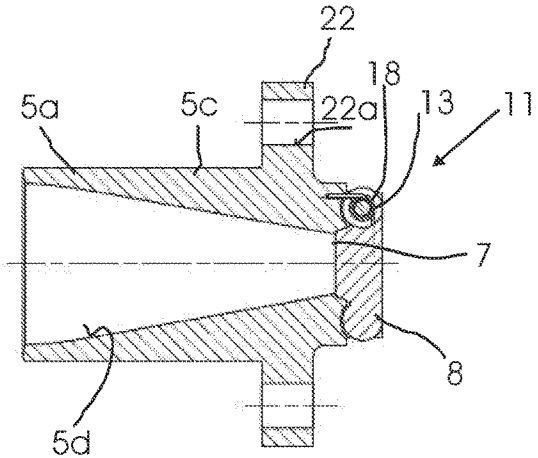
FIG. 13 a view of the boring nozzle as in FIG. 12, but here as a sectional view.
Figure 10:
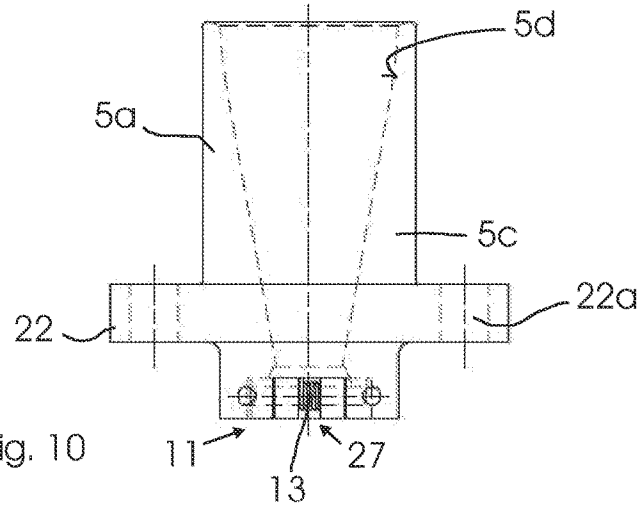
FIG. 10 a top view of a boring nozzle of the tool with a spring in cutting mode.
Figure 12:
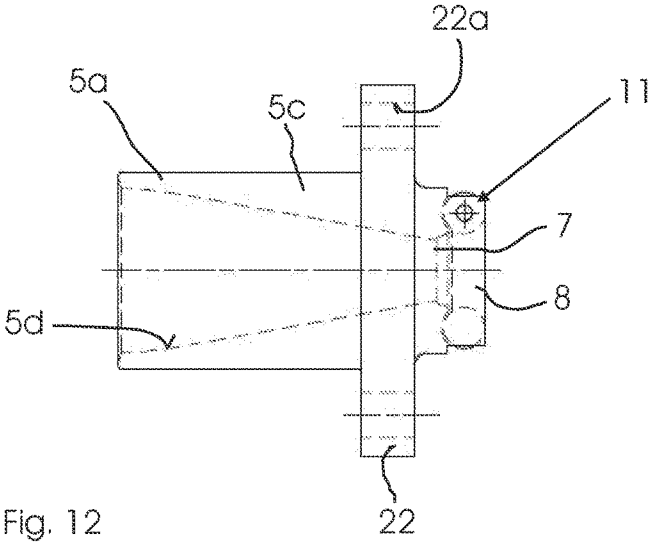
FIG. 12 a side view of the boring nozzle of FIGS. 10 and 11.

A cutting nozzle 5*b* with a larger dimension is shown in FIGS. 6-9. It generally comprises a nozzle housing 5*c* and a nozzle flange 22 formed on the front end of the cutting nozzle 5*b*, which is fastened in the receiving opening 3*a* of the housing wall 3 by means of screws 23 (FIGS. 4 and 5). In FIGS. 6 and 7, the cutting nozzle 5*b* is shown in the closed position of the flap 8, while the FIGS. 8 and 9 show the same cutting nozzle 5*b* in the open position of the flap 8. The cutting nozzle 5*b* comprises in addition to the nozzle housing 5*c* a projection 24, in which the opening 7 of the cutting nozzle 5*b* is located, which is closable with the flap 8 in its shown closed position. A nozzle channel 5*d* tapering from the inside towards the outside extends through the nozzle housing 5*c* with the opening 7 on its outer end.

The opening 7 of the cutting nozzle 5*b* is surrounded by a collar 14 protruding from the projection 24 of the cutting nozzle 5*b*, the collar 14 presenting an upper gap 16 on its upper end, to which are adjacent upper collar ends 14*a*, 14*b*. Diametrically opposed is a lower gap 17 of the collar 14 with corresponding lower collar ends 14*c*, 14*d*.

In the upper gap 16 of the collar 14, a swivel joint 11 is arranged, which consists of a pin 18 as a rotary axis bridging the upper gap 16 of the collar 14 and anchored in the upper collar ends 14*a*, 14*b* on both sides of the upper gap 16 of the collar 14 and a corresponding bearing bore 19 in the upper end of the flap 8. Alternatively, the bearing bores 19 can also be arranged in the upper collar ends 14*a*, 14*b* and the pin 18 itself in the upper end of the flap 8 for formation of the swivel joint 11. In this manner, as shown in FIGS. 6 through 9, the flap 8 can be pivoted by the swivel joint 11 out of the closed position (FIGS. 6 and 7) into the open position (FIGS. 8 and 9) and vice versa out of the open position back into the closed position. In the closed position, the flap 8 lies with an inner projection 25, which has a smooth-surfaced and circular closing surface 20 on the inside, on a complementary bearing surface 21 of a recess 26 in the projection 24 of the cutting nozzle 5*b*, as the drawing shows.

A preferred further embodiment of the nozzles is shown in FIGS. 10 through 13, wherein it concerns a boring nozzle 5*a*, the design of which however also generally applies for cutting nozzles 5*b*—except for slight differences like differently designed nozzle channels 5*d*. The further embodiment consists in the arrangement of a spring 13—designed as a leg spring in the present example—for pivoting the flap 8 from the open position into the closed position. The spring 13 is, as the drawings show, attached in a recess 27 on the upper end 9 of the flap 8 such that the spring legs push the flap 8 into the closed position and hold it there when the respective nozzle, here the boring nozzle 5*a*, is inactive. The flap 8 is designed like a fork at the upper end due to the recess 27. Otherwise, the design of this boring nozzle 5*a* corresponds with the nozzle designs described above, in particular those according to FIGS. 6 through 9, so that a further description is not required.

The operating mode of tool 1 and the method performable with the tool 1 are as follows:

As soon as the tool 1 is lowered into a drum (not shown here) filled with coke with the rotating boring rod (also not shown) and the coke quantity is reached in the drum, high-pressure water is fed to the boring nozzles 5*a* on the bottom side of the tool 1 via the flow channels 4*h*. The high-pressure water flows through the opening 7 of each boring nozzle 5*a* and pushes the flap 8 held by the spring 13 in the closed position out of its closed position and pivots it into the open position, so that a high-pressure water jet exits the boring nozzle 5*a* and the coke is crushed and a vertical central opening or respectively a corresponding channel can be cleared through the mass of coke. During this step of the method, the flap 8 is held in the open position by the high-pressure water jet 28 exiting the boring nozzle 5*a*, and the flaps 8 of the cutting nozzles 5*b* are held in the closed position by their springs 13. This position corresponds with the representations in FIGS. 6 and 7.

As soon as the central, vertical opening or respectively the channel in the coke mass of the drum is cleared out, the pressurized water infeed stops so that the boring and cutting nozzles 5*a*, 5*b* are closed by the flaps 8. The tool 1 is now raised upwards through the opening with the boring rod. In the upper position of the tool 1, the crushing and clearing out of the coke begins via the drum cross-section, wherein the tool 1 hanging on the rotating boring rod travels a spiral path downwards. For this section, high-pressure water is fed to the cutting nozzles 5*b* so that their flaps 8 are pivoted out of the closed position into the open position against the pressure of their springs 13 and high-pressure water jets 28 can freely exit the cutting nozzles 5*b* wherein the flaps 8 are held in their open position by the high-pressure water jets 28. While the tool 1 is in this cutting mode, the boring nozzles 5*a* are not activated so that their openings 7 are closed by the flaps 8, which are spring pressurized.

As soon as the coke in the drum is completely crushed and discharged in this second process step, the pressurized water infeed is stopped completely so that the openings 7 in the boring and cutting nozzles 5*a*, 5*b* are closed and protected by the flaps 8, which are spring pressurized.

FIG. 14-17*c* show an important further embodiment of the design of the tool 1 described above. It is characterized in that the flap 8 for closing and releasing the opening 7 of the respective boring or cutting nozzle 5*a*, 5*b* is designed in multiple parts, is namely replaced by two wings 8*a*, 8*b*, which work together to assume the function of the one-part flap 8 described above. The division of the flap 8 into two opposite-lying, respectively pivotingly mounted wings 8*a*, 8*b*, which close the opening 7 of the boring or cutting nozzle 5*a*, 5*b* like rotatable gate wings in the closed position and release the opening 7 when pivoted to the outside, causes structural differences with respect to the exemplary embodiment described above, which will be explained below with reference to FIG. 14-17*c:*

Figures 15, 15A:
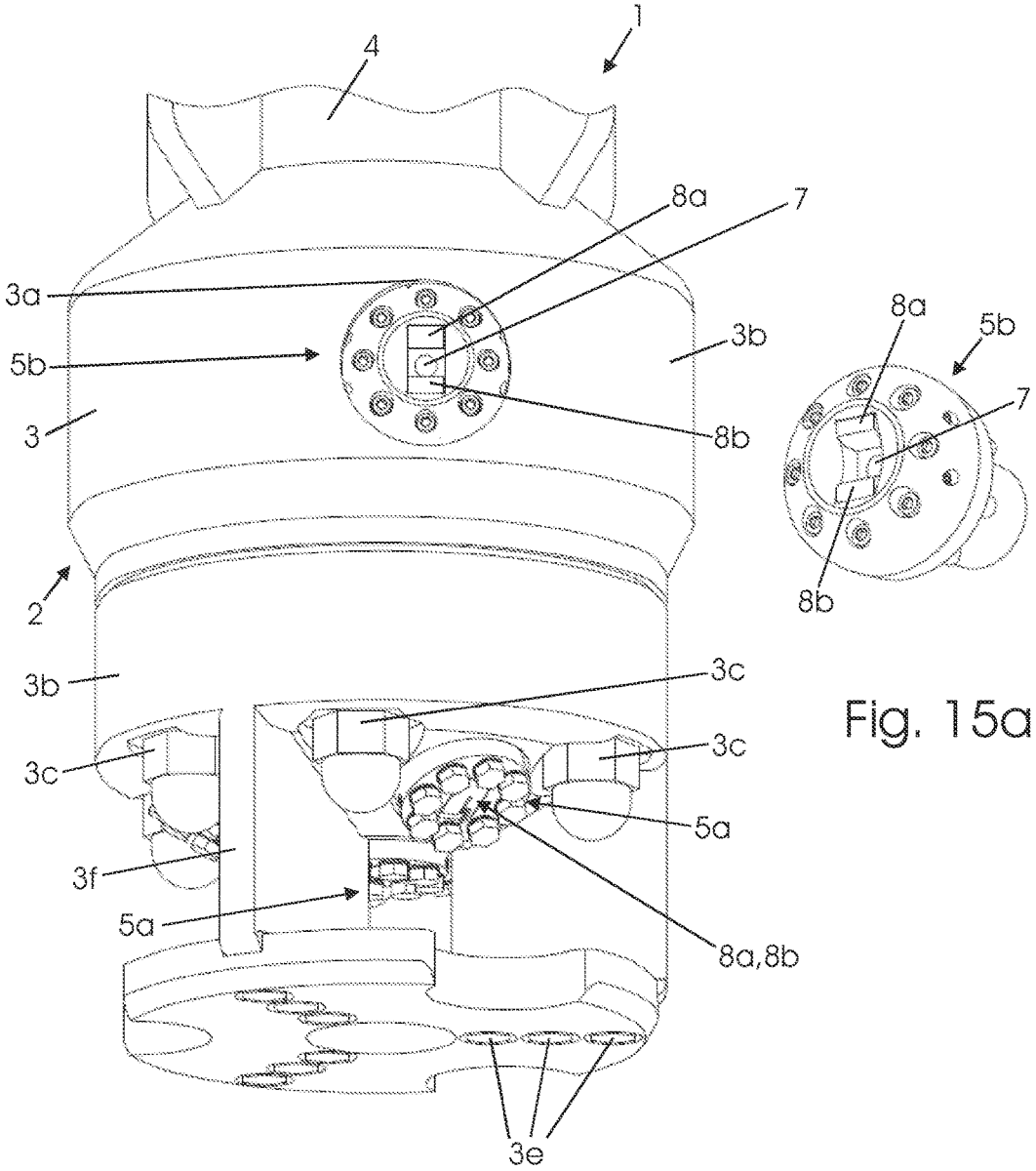
FIG. 15 a perspective view of a bottom part of the tool as in FIG. 14, but here in the cutting mode of the tool with a multi-part flap.
FIG. 15*a* a perspective view of a cutting nozzle with a multi part flap in an open position.

FIGS. 14 and 15 correspond mainly with the representations in FIGS. 4 and 5 and show the bottom part 2 of the tool 1 with the housing wall 3 with the wings 8*a*, 8*b* for closing or releasing the opening 7 of the boring and cutting nozzles 5*a*, 5*b* while the remaining structure of the tool 1 corresponds with the design described above.

Because the area of the wings 8*a*, 8*b* of the boring and cutting nozzles 5*a*, 5*b* in FIG. 14, where the boring mode of the tool 1 is shown, and also in FIG. 15, where the cutting mode of the tool 1 is shown, can only be shown more schematically, FIG. 14 and FIG. 15 are enhanced by the drawings of the cutting nozzle 5*b* in FIG. 14*a* in boring mode and in FIG. 15*a* in cutting mode. This makes it easier to understand that the wings 8*a*, 8*b* of the cutting nozzle 5*b* are in the closed position in FIG. 14*a* and close the opening 7 of the cutting nozzle 5*b* (not shown)—because the tool 1 is in boring mode—while the boring nozzles 5*a* arranged on the bottom part 3*b* of the tool 1 are active, for which the openings 7 of the boring nozzles 8*a* are released for the exit of the high-pressure water jets in that the wings 8*a*, 8*b* are pivoted to the outside into the open position. For the sake of better clarify of the drawing, FIG. 14 only shows the wings 8*a* and the wings 8*b* are left out. In contrast, FIG. 15 and above all FIG. 15*a*, where the tool 1 is in cutting mode, shows both respectively outwardly pivoted wings 8*a*, 8*b* and also the thereby released opening 7 of the shown cutting nozzle 5*b*. In contrast, the wings 8*a*, 8*b* of the boring nozzles 5*a* are held in the closed position.

It results from FIGS. 16*a*-17*c* that for this design a protective cap 29 is used for the multi-part flap through use of two rotatably mounted wings 8*a*, 8*b*, which has several openings 30 for receiving screws 31 for fastening the protective cap 29 on a nozzle flange 22', which is in turn fastened on the housing wall 3 or respectively engages in it by means of screws 23'.

In the centered position of the protective cap 29, a recess 32 that is rectangular in cross-section (FIG. 16*c*) is located on its top side, in which the wings 8*a*, 8*b* with parallel rotational axes lie opposite each other in a rotary manner on pins 35, as the drawing shows. At the transition of the opening 7 to the recess 32, a ledge 33 is formed, to which receiving areas 34 connect to form the recess 32 and to receive the wings 8*a*, 8*b*.

Figure 16A:
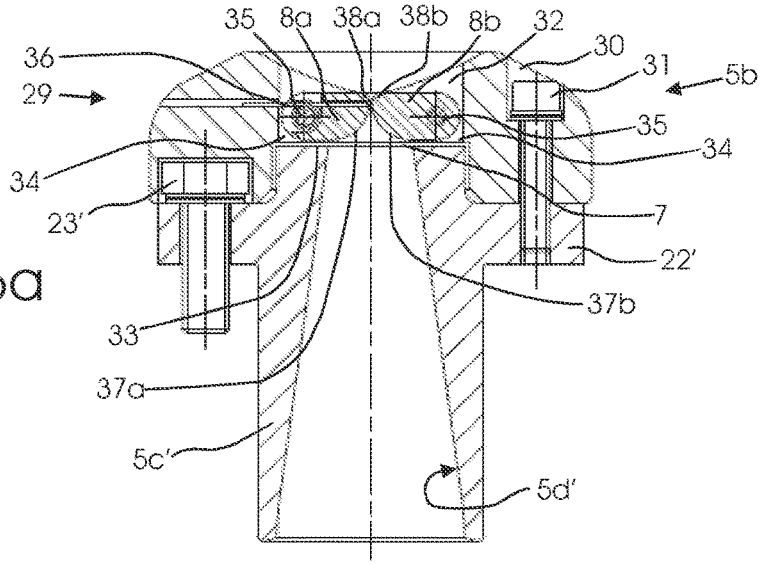
FIG. 16*a* a sectional view of a cutting nozzle provided with a multi-part flap in a closed position.
Figure 16B:
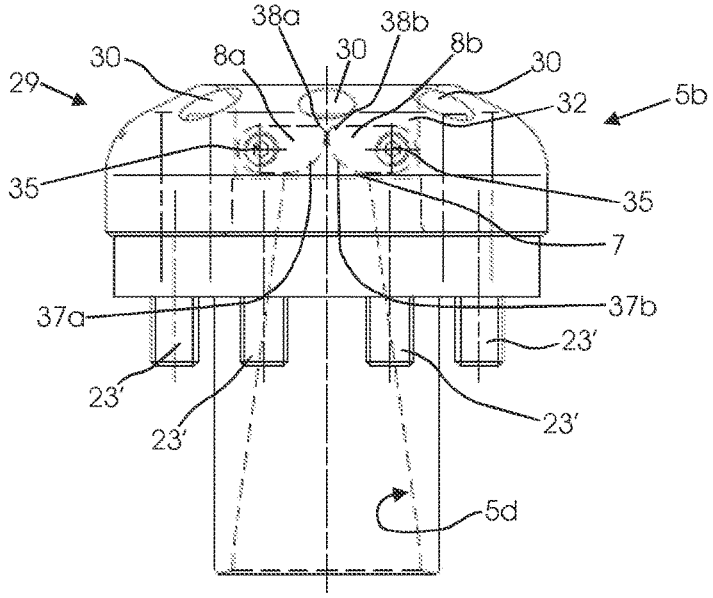
FIG. 16*b* a side view of the cutting nozzle of FIG. 16*a* with a multi-part flap also in the closed position.
Figure 16C:
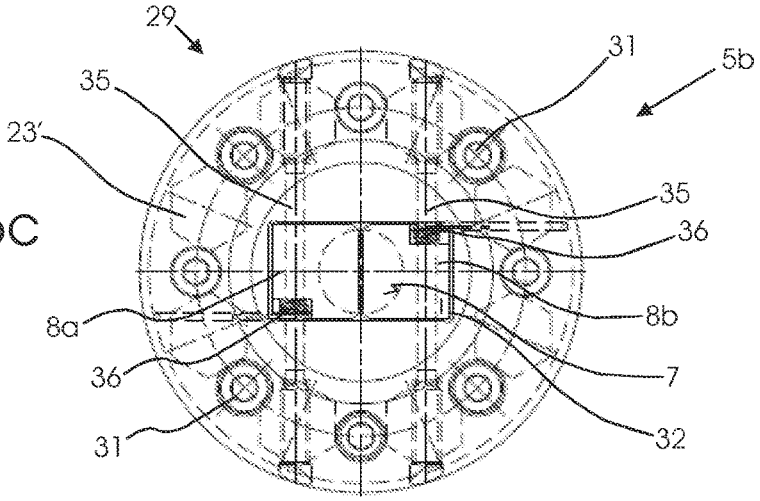
FIG. 16*c* a top view of the cutting nozzle of FIGS. 16*a* and 16*b* with a multi-part flap in a closed position.
Figure 17A:
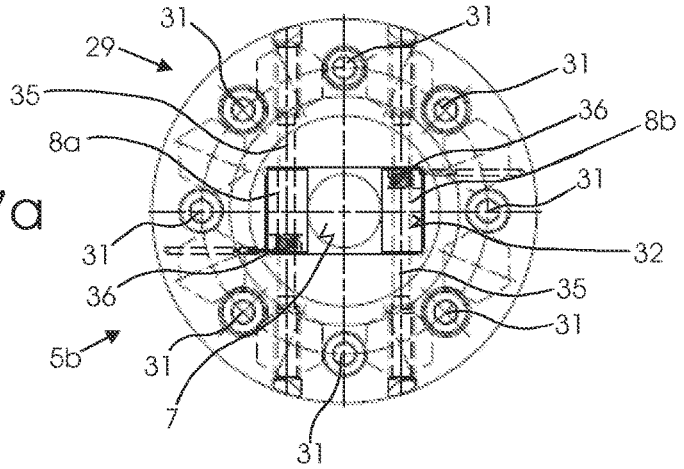
FIG. 17*a* a top view of a cutting nozzle as in FIG. 16*c*, but here in an open position.
Figure 17B:
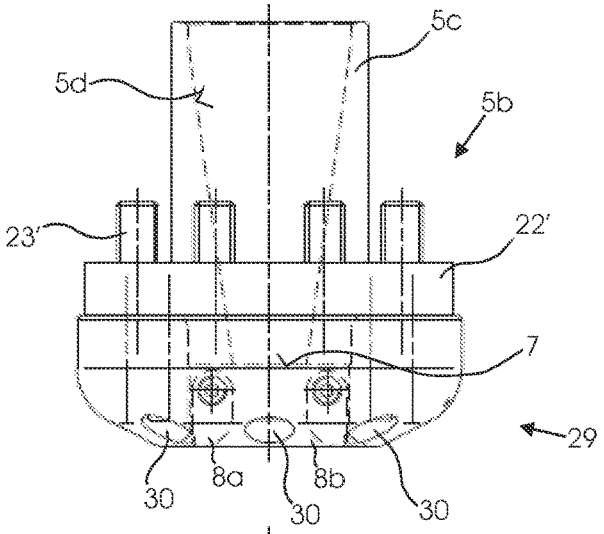
FIG. 17*b* a side view of a cutting nozzle with a multi-part flap as in FIG. 17*a* also in an open position.
Figure 17C:
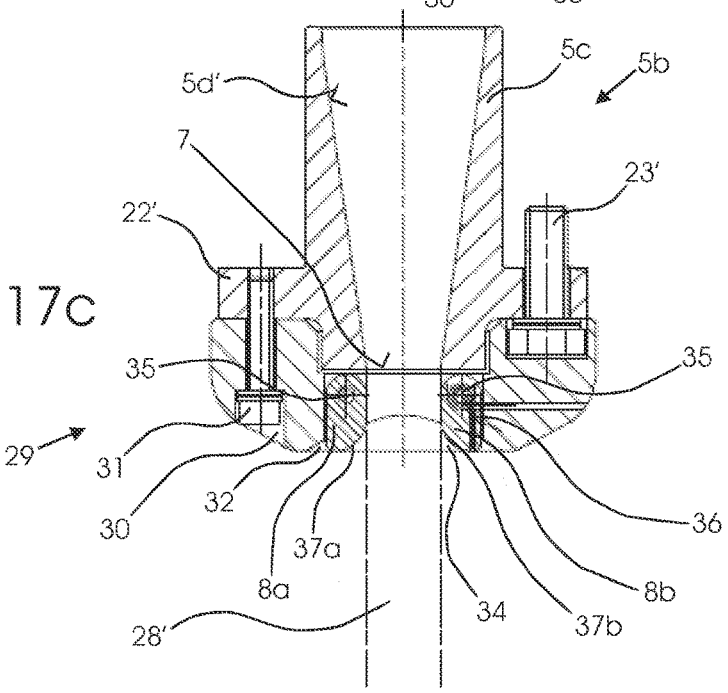
FIG. 17*c* a longitudinal sectional view of the cutting nozzle shown in FIGS. 17*a* and 17*b* with a multi-part flap in an open position.

The wings 8*a*, 8*b* are pressed respectively into their closed position by a torsion spring 36, for which their facing narrow sides 37*a*, 37*b* are rounded above all on the upper edges 38*a*, 38*b* visible in FIG. 16*a*. Through this design, the wings 8*a*, 8*b* can be pivoted from the open position, which is shown in FIGS. 17*a*, 17*b* and 17*c*, to the closed position shown in FIGS. 16*a*, 16*b* and 16*c* by the force of the torsion spring 36, in which they securely close the opening 7. As the drawings show, the size of the recess 32 is set to the width of the wings 8*a*, 8*b* such that the wings 8*a*, 8*b* are generally arranged in a protected manner in the protective cap 29 and also do not protrude to the outside in the open position (FIG. 17*c*).

The described design of the multi-part flap or respectively of the wings 8*a*, 8*b* that work together applies the same to boring and cutting nozzles 5*a*, 5*b*.

The transition from the closed position to the open position and vice verse is performed in this embodiment analogously to the first exemplary embodiment described above with a one-part flap 8. If e.g. the boring nozzles 5*a* are closed in the cutting mode, the wings 8*a*, 8*b*, as shown e.g. in FIGS. 16*a*, 16*b* and 16*c*, are pivoted to the inside under spring pressure so that the opening 7 is closed and thus protected. During the transition from the cutting mode to the boring mode, the wings 8*a*, 8*b* are pivoted to the outside to the open position shown in FIGS. 17*a*, 17*b* and 17*c* against the spring pressure by the high-pressure water flowing through the nozzle channel 5*d'* so that a high-pressure water jet 28' can exit unhindered from the released opening 7 and holds the wings 8*a*, 8*b* in the open position due to force of the jet. Previously, the wings 8*a*, 8*b* of the boring nozzles 5*a* already assumed their closed position through pivoting from the open position (not shown).

A more detailed description of the function and the thereby resulting procedural method is not necessary in light of the comprehensive explanations for the first exemplary embodiment.

The above description of the exemplary embodiments simultaneously illustrates examples of the nozzle according to the invention and of the method according to the invention.

The invention claimed is:

1. A tool for crushing coke in drums by means of high-pressure water jets, which has a housing (2) with a feed system (4) for high-pressure water and a housing wall (3) with outwardly directed boring and cutting nozzles (5*a*, 5*b*), out of the openings (7) of which high-pressure water jets (28) exit as well as flow channels (4*g*, 4*h*), which connect the feed system (4) with the boring and cutting nozzles (5*a*, 5*b*), wherein the opening (7) of the boring or cutting nozzle (5*a*, 5*b*) is closable respectively with a flap (8), which is adjustable between a closed position and an open position.

2. The tool according to claim 1, wherein the flap (8) is attached on one end of a nozzle channel (5*d*) next to the opening (7) of the boring or cutting nozzle (5*a*, 5*b*) respectively with a swivel joint (11) on the housing (2) of the tool (1).

3. The tool according to claim 2, further comprising a spring (13), which causes the pivot movement of the flap (8) from the open position to the closed position and holds the flap (8) in the inactive phase of the boring or cutting nozzle (5*a*, 5*b*) in its closed position.

4. The tool according to claim 1, wherein the opening (7) of the boring or cutting nozzle (5*a*, 5*b*) and the flap (8) are arranged on a nozzle flange (22) fastened on the housing (2).

5. The tool according to claim 1, wherein the opening (7) of the boring or cutting nozzle (5*a*, 5*b*) is surrounded outside on the housing (2) of the tool (1) by a collar (14), which has an upper gap (16) on its top side (15), in which an upper end (9) of the flap (8) is arranged with a swivel joint (11).

6. The tool according to claim 5, wherein the swivel joint (11) comprises a pin (18) bridging the upper gap (16) and anchored in upper collar ends (14*a*, 14*b*) on both sides of the upper gap (16) as the rotational axis and a corresponding bearing bore (19) in the upper end of the flap (8), with which the pin (18) forms the swivel joint (11).

7. The tool according to claim 5, wherein the collar (14) has on its bottom end a second lower gap (17) lying opposite the first upper gap, into which a bottom end (10) of the flap (8) pivots when the flap (8) assumes its closed position.

8. The tool according to claim 1, wherein the flap (8) has a level, circular projection (25) on its inside (20), which in the closed position abuts against a projection (24) of the boring or cutting nozzles (5*a*, 5*b*) surrounding the opening (7) of the boring or cutting nozzle (5*a*, 5*b*), wherein the projection (24) has a bearing surface (21) complementary to a bearing surface of the projection (25).

9. The tool according to claim 1, wherein the flap (8) is designed in multiple parts and comprises opposite-lying respectively pivotingly mounted wings (8*a*, 8*b*), which close the opening (7) of the boring or cutting nozzle (5*a*, 5*b*) in the closed position like rotatable gate wings when they are adjacent to each other in a plane vertical to a nozzle channel (5*d*) and release the opening (7) in that they are respectively rotated to the outside in a pivoting manner.

10. The tool according to claim 9, wherein the wings (8*a*, 8*b*) are arranged in a rectangular recess (26) of a protective cap (29) attached in the area of the opening (7).

11. The tool according to claim 10, wherein the width of the recess (26) is selected larger than the diameter of the opening (7) of the boring or cutting nozzle (5*a*, 5*b*) such that behind a ledge (33) receiving areas (34) are formed for the wings (8*a*, 8*b*).

12. The tool according to claim 10 wherein the wings (8*a*, 8*b*) are mounted opposite each other in a rotary manner with parallel rotational axes in the recess (26) respectively by means of a pin (18).

13. The tool according to claim 9, wherein the wings (8*a*, 8*b*) in the inactive phase of the boring or cutting nozzle (5*a*, 5*b*) are pressed into the closed position by means of torsion springs (36) and in the active phase of the boring or cutting nozzle (5*a*, 5*b*) are pivoted and held in the open position by the high-pressure water jet against the spring effect, in which they release the opening (7) of the boring or cutting nozzle (5*a*, 5*b*).

14. The tool according to claim 9, wherein narrow sides (37*a*, 37*b*) of the wings facing each other in the closed position of the boring or cutting nozzle (5*a*, 5*b*) are designed respectively rounded on one edge (38*a*, 38*b*) for pivoting the wings (8*a*, 8*b*) into the closed position.

15. A method for operating a tool for crushing coke in drums by means of high-pressure water jets, wherein the method is performed with a tool (1) according to claim 1.

* * * * *